US006559589B2

(12) United States Patent
Yoon

(10) Patent No.: US 6,559,589 B2
(45) Date of Patent: May 6, 2003

(54) FLAT-TYPE CATHODE RAY TUBE

(75) Inventor: Thae-Seok Yoon, Pupyong-gu Inchun-metropolitan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/832,177

(22) Filed: Apr. 11, 2001

(65) Prior Publication Data

US 2002/0027410 A1 Mar. 7, 2002

(30) Foreign Application Priority Data

Apr. 12, 2000 (KR) ..... 2000-19352

(51) Int. Cl.[7] ..... H01J 29/10; H01J 31/00
(52) U.S. Cl. ..... 313/461; 313/477 R; 313/402
(58) Field of Search ..... 313/407, 408, 313/477 R, 478, 428, 461, 402, 427

(56) References Cited

U.S. PATENT DOCUMENTS 4,943,754 A * 7/1990 Hirai et al. ..... 313/477 R
5,216,321 A * 6/1993 Kawamura et al. ..... 313/479
5,962,964 A * 10/1999 Sano et al. ..... 313/440
6,016,028 A * 1/2000 Iguchi et al. ..... 313/402
6,025,676 A * 2/2000 Ohama et al. ..... 313/477 R
RE36,838 E * 8/2000 Sugawara et al. ..... 313/477 R
6,133,681 A * 10/2000 Nakamura et al. ..... 313/402
6,225,735 B1 * 5/2001 Nakagawa et al. ..... 313/407
6,333,594 B1 * 12/2001 Nakagawa et al. ..... 313/461
6,342,760 B1 * 1/2002 Mashimo et al. ..... 313/477 R
6,388,373 B1 * 5/2002 Nah ..... 313/474
6,414,425 B1 * 7/2002 Yokota et al. ..... 313/461
6,448,706 B1 * 9/2002 Kawamura et al. ..... 313/477 R

* cited by examiner

*Primary Examiner*—David Martin
*Assistant Examiner*—Dameon E. Levi
(74) *Attorney, Agent, or Firm*—Fleshner & Kim, LLP

(57) ABSTRACT

A flat-type cathode ray tube which improves the brightness and color purity of a picture by improving a curvature of an inner surface of a panel of the cathode ray tube thereby preventing the mislanding of the electron beam, doming, howling, errors due to the magnetic field of the earth magnetism, and the like. The flat-type cathode ray tube includes a panel for displaying a picture, the outer surface of the panel is planar with an inner surface having inner surface curvatures, respectively, along the vertical axis direction and the horizontal axis direction.

10 Claims, 7 Drawing Sheets

FLAT-TYPE CATHODE RAY TUBE

BACKGROUND OF THE INVENTION

1. Field of the Invention

The present invention relates to a flat-type cathode ray tube (CRT) and more particularly to an improvement of a curvature of a panel for the CRT.

2. Description of the Related Art

In general, the CRT is an image display device for displaying a picture signal received thereto as an image and is divided into a curved type having a predetermined curvature in both the inner surface and the outer surface of the panel and a flat type wherein the inner surface of the panel has a predetermined curvature, while the outer surface thereof is substantially flat.

FIG. 1 shows a sectional view of a conventional curved-type CRT, and FIG. 2 shows an exploded perspective view of a shadow mask and a frame constituting the curved-type CRT of FIG. 1. FIG. 3*a* shows a top view of a panel assembly having a show mask and an inner shield combined therewith and FIG. 3*b* shows an operational view of the panel assembly.

The curved-type CRT used in general will be explained with reference to the associated drawings.

As shown in FIG. 1, the conventional curved-type CRT comprises a rectangular panel of which outer surface has a predetermined curvature, a nude-type funnel and an electron gun assembly.

More specifically, the panel 1 comprises a phosphor screen 4 formed by depositing red, green and blue phosphors on the inner face of the panel 1 and a shadow mask 3 which is installed on the inner surface of the panel 1 at a predetermined space relationship therewith and which has a rectangular frame 7 fixed to the rear side thereof. Also, an inner shield plate 9 is attached to the rear side of the frame 7. A funnel 2 comprises a neck portion 110 into which an electron gun assembly for emitting electron beams 6 based on received picture signals is inserted.

Further, as shown in FIG. 2, the shadow mask 3 comprises a number of fine apertures 31 for passing through electron beams emitted from the electron gun and its whole skirt portion is welded on the inner wall or outer wall of the frame 7 by means of a welding process.

Also, the frame 7 includes a flat portion in parallel to its short axis direction in every edge of the outer wall thereof and has an elastic supporting member, spring 8, fixed to one side of the flat portion.

The spring 8 has a first arm portion and a second arm portion being contacted at a predetermined angle each other, wherein the first arm portion has a hole on its surface (not shown) to be held on a stud pin of the frame and the second arm portion is fixed to the flat portion by welding.

As stated above, by installing the frame 7 having the shadow mask 3 fixed thereto onto the inner surface of the panel 1 and the inner shield plate 9 on the rear side of the frame 7, a panel assembly is formed as shown in FIG. 3*a*.

Especially, the panel 1 has the radius of curvature defined by a level difference between the center of the inner surface of the panel 1 and the outer end of effective area thereof, and comprises stud pins 10 which are anchored on two or three edge portions of the inner wall of the panel 1.

The process for displaying picture through a conventional CRT having such construction will be described hereafter.

When image signals are input to the electron gun, electron beams 6 as the image signals are emitted from the gun to the phosphor screen 4. The electron beams 6 emitted are deflected by deflection york, pass through a number of apertures 31 of the shadow mask and radiate red, green and blue phosphors on the phosphor screen deposited the inner surface of panel 1 thereby to display the picture.

At this time, about 20% of the electron beams pass through apertures 31 of the shadow mask and the rest 80% collides with the shadow mask, resulting in the rising in temperature of the shadow mask and frame.

Thus, in the shadow mask comprised of AK material or invar alloy having a low thermal expansion coefficient and the frame comprised of iron having a high thermal expansion coefficient, the frame is expanded during the early rising in temperature and then the shadow mask 3 is also expanded as time passes by.

Referring to the operation diagram of FIG. 3*b*, the dotted line shows a shape of the shadow mask 3 and the frame 7 of the curved-type CRT before operation, while the solid line shows a shape of the shadow mask 3 and the frame 7 of the CRT, wherein the position of the shadow mask 3 and the frame 7 are shifted due to the rising in temperature caused by electron beams in operation.

That is, the shadow mask 3 and the frame 7, which were increased in volume due to their temperature rising, are shifted toward phosphor screen. Such shift of the shadow mask and the frame can be recompensed by a repelling power of the spring 8 as an elastic supporting member, however, it is difficult for the shadow mask to be returned to its position before operation.

Therefore, when electron beams are scanned onto phosphors on the phosphor screen in the inner surface of the panel, an amount of variation (ΔLE) in landing of electron beam at the phosphors (referred to as "mislanding quantity (ΔLE)" hereinafter) appears because of the position change of the apertures 31 caused by the shift of the shadow mask 3.

Also, when the impact energy generated by external impact or a sound pressure of speaker arrives at the frame 7 and the shadow mask 3 through the stud pin 10 and the spring 8, so-called doming phenomenon which causes a tremble of the shadow mask occurs. As a result, the position of the apertures 31 is changed and the mislanding quantity (ΔLE) of the electron beam occurs, thereby deteriorating transmissivity of electron beams and the brightness of a picture and lowering the color purity of the picture with the incorrect beam arrangement.

Further, because of a low height of the frame in the short axis direction due to the curved shape of panel, the frame does not fully wrap the outer portion of the shadow mask, thereby causing a significant deformation of the shadow mask in manufacturing it or an occurrence of black stripes on the screen due to the mislanding of the electron beam.

In addition, since the inner shield plate attached on the rear side of the frame so as to prevent magnetic field of the earth magnetism has also a smooth plane shape on both the long peripheral portion and the short peripheral portion, a magnetic flux is not easily concentrated onto the long peripheral portion, the short peripheral portion as well as the corner portion. As a result, the magnetic field of the earth magnetism is not shielded effectively and thus the electron beam is deflected, resulting in occurrence of mislanding quantity (ΔLE) of the electron beam and deterioration of the color purity of picture.

SUMMARY OF THE INVENTION

In order to solve the above mentioned problems, it is the object of the present invention to improve the brightness and color purity of picture by reducing the mislanding of the electron beam, thereby preventing doming, howling, magnetic field of the earth magnetism and the like.

To do this, the present invention provides a flat-type cathode ray tube comprising a panel for displaying a picture, wherein the outer surface of the panel is plane and the inner surface thereof has inner surface curvatures respectively along the vertical axis direction and the horizontal axis direction.

DETAILED DESCRIPTION OF THE PREFERRED EMBODIMENT

A flat-type cathode ray tube according to a preferred embodiment of the present invention will be explained with reference to the accompanying drawings.

Figure 4:
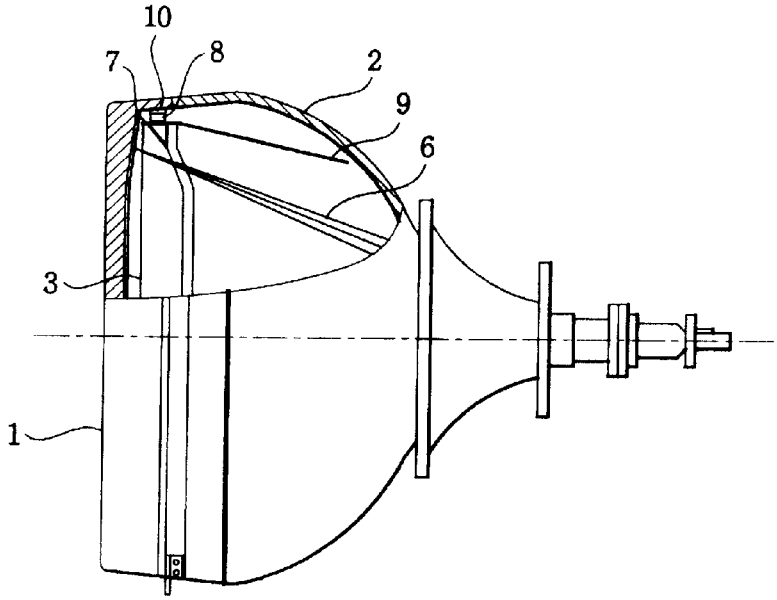
FIG. 4 is a sectional view of a flat-type cathode ray tube according to the present invention.

As in FIG. 4, a flat-type cathode ray tube according to the present invention comprises a rectangular flat panel 1, a nude-type funnel 2 constituting an envelope and an electron gun.

The flat panel 1 of the present invention which is a portion for displaying a picture has a safety glass for explosion which is attached to the outer surface thereof and a phosphor screen formed on the inner surface of the panel 1 by depositing regularly red, green and blue phosphors. Also, the end portion of the panel 1 is curved in its rear direction, thereby to form an inner side wall. Stud pins 10 are anchored on edge portions of the inner wall. The shadow mask 3 is installed on the rear side of the panel 1 at a predetermined space relationship therewith.

In this cathode ray tube according to the present invention, only 20% of electron beams 6 composed of red, green and blue phosphors emitted from the electron gun pass through the apertures 31 of the shadow mask and radiates the phosphors to emit each color.

Figure 1:
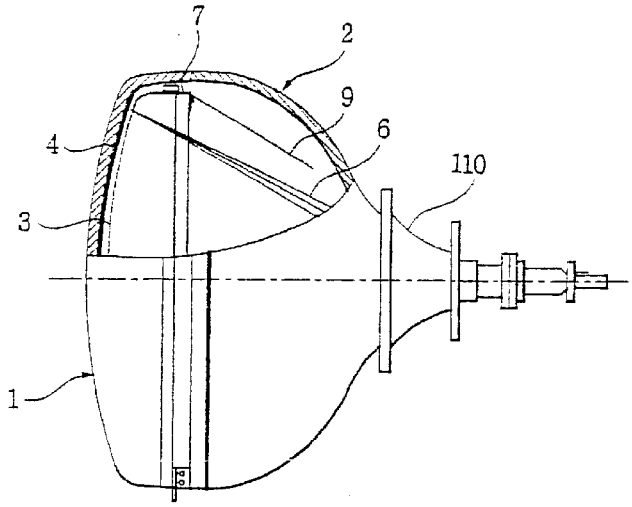
FIG.1 PRIOR ART
FIG. 1 is a sectional view of a conventional curved-type cathode ray tube.
Figure 2:
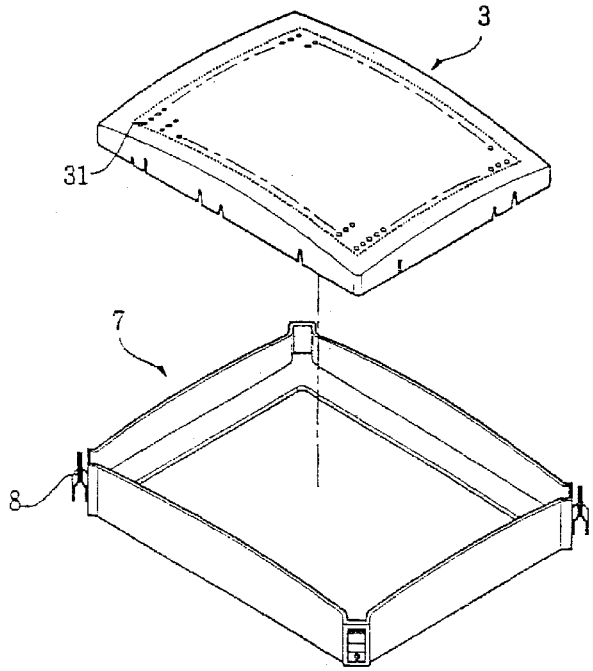
FIG.2 PRIOR ART
FIG. 2 is an exploded perspective view of a shadow mask and a frame constituting the curved-type cathode ray tube of FIG. 1.
Figure 3A:
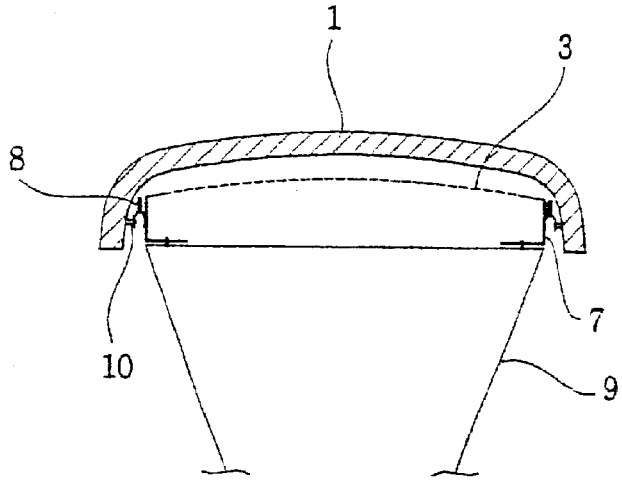
FIG.3a PRIOR ART
FIG. 3*a* is a top view of a panel-frame assembly.
Figure 3B:
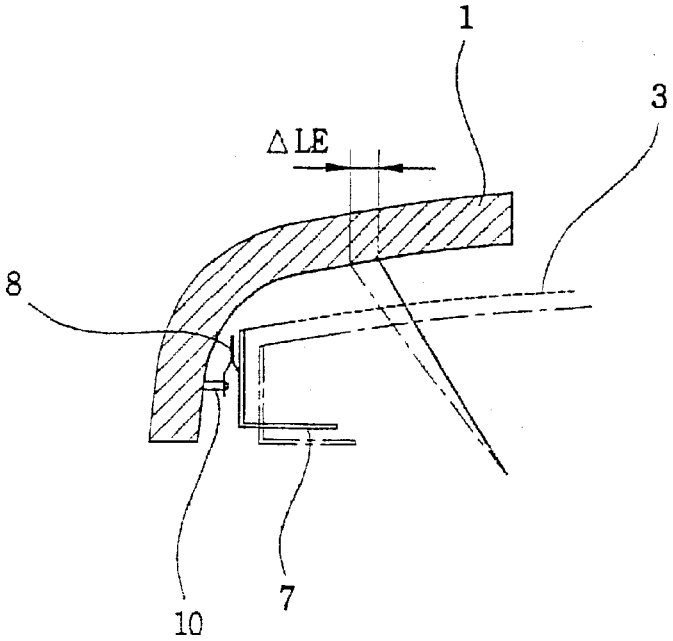
FIG.3b PRIOR ART
FIG. 3*b* is a operational view of a panel-frame assembly.

To describe in detail, as shown in FIG. 2, the shadow mask 3 is formed of an invar material having a low thermal expansion coefficient with 0.1 mm through 0.3 mm thickness and has a number of apertures 31 arranged thereon in regular interval. The frame 7 having a rectangular shape is formed of an iron having a high thermal expansion coefficient with 0.5 mm through 2 mm thickness. Also, a flat portion is formed on the edge of the outer wall of the frame 7 in parallel to its short axis direction.

In the above described shadow mask 3, the skirt portion of the shadow mask 3 is welded to be contacted with the inner wall of the frame or is welded to the outer wall of the frame 7 by forming the shadow mask 3 bigger than the frame 7.

And, the second arm portion of the spring 8 comprised of strong elastic material of 0.2 mm through 1.5 mm thickness is fixably welded to the flat portion of said frame 7 and the first arm portion of the spring 8 being contacted to the second arm portion at a predetermined angle includes a hole.

Figure 5:
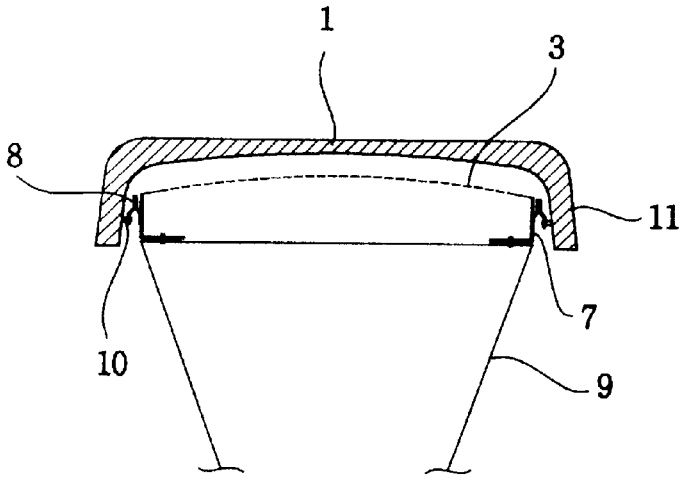
FIG. 5 is a top view of a panel assembly of the flat-type cathode ray tube according to the present invention.

As seen in FIGS. 4 and 5 showing a plan view of the panel for the flat-type cathode ray tube, in order to install the frame 7 having said shadow mask 3 welded thereon onto the panel 1, said stud pin 10 is inserted into the hole of the first arm portion of the spring 8 to maintain a predetermined space relationship between the shadow mask 3 and phosphor screen 4.

The flat cathode ray tube having this configuration is not capable for preventing a conventional doming and howling phenomenon caused by the position change of a shadow mask, resulting in deterioration of brightness and color purity of a picture.

Thus, in accordance with the present invention, in order to solve the defects of the conventional curved-type cathode ray tube in which an image distortion is severe and the reflection rate for reflecting the external light is high, the outer surface of the panel 1 is designed to be planar and the inner surface of the panel 1 is designed in a manner that the doming, howling, explosion, etc. as described above can be prevented effectively, as described in detail hereunder.

Generally, the strength of a panel is lowered as much as the panel is flattened on the curved surface and thus the panel 1 of the present invention should be firstly designed so as to be flattened and having a durability to the extent of satisfying explosion according to the following equation.

$$(Pi)cr=(0.14\times 3.2/\lambda^2)Kc \qquad \text{equation (1)}$$

To insert the following factors into the above equation (1):

$$Kc = 2/3(1-v^2)E(t/R)2$$

$$= [12(1-v^2)]1/4\ R/t\ 2\sin(\theta/2)$$

Wherein

ν: Poisson rate

E: elastic coefficient

R: radius of curvature

Φ: angle defined by the center and the end portion

Kc, λ: coefficient (Pi)cr: a critical curving weight

To express the equation 1 based on the radius R of curvature of panel of the CRT, it is represented as $$(Pi)cr\propto 1/R.$$

That is, although the strength of panel 1 is increased as the radius of curvature lowers, the curvature of the inner surface of panel is limited to the increased curvature having the durability to the extent of satisfying an explosion characteristic because an image distortion of displayed picture and the reflection of light should be lowered.

Therefore, to have the radius of curvature capable of preventing the deterioration of flatness and strength of the panel 1 as well as a trembling of the mask due to the impact energy, the curvature of the inner surface of the rectangular panel is designed dividedly into the long peripheral portion, the short peripheral portion and the diagonal peripheral portion.

To limit the range of the curvature of the inner surface of the panel 1 to order to achieve this effects, the long and short axises are designed dividedly $$0.51<(Zmin-Zcen)-(Zcor-Zmaj)<0.6,$$

$$0.51<(Zmaj-Zcen)-(Zcor-Zmin)<0.6.$$

wherein,

Zcen is a thickness at a center of the inner surface of the panel, Zmaj is a difference between the thickness at the center of the inner surface of the panel and a thickness at an end portion of the effective area of a long side portion of the panel, Zmin is the difference between the thickness at the center of the inner surface of the panel and a thickness at the end portion of effective area of the short side portion, and Zcor is the difference between the thickness at the center of the inner surface of the panel and a thickness at the end portion of effective area of the diagonal portion.

In the curvature structure of the shadow mask, if one direction, that is, the portion (Zmin−Zcen)−(Zcor−Zmaj) exceeds 0.6, the radius of the curvature between the long axis and the end portion of the long side portion is increased, which causes a deterioration in its supporting strength along the long axis direction and a howling phenomenon which trembles the shadow mask. As a result, since the color purity of the CRT is deteriorated in operation, it is difficult to obtain a fine image.

Figure 6:
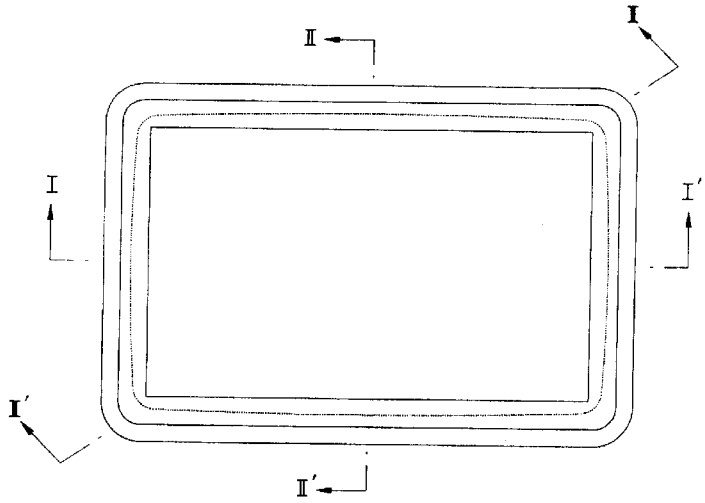
FIG. 6 is a plan view of the panel of a flat-type cathode ray tube.

FIG. 6 shows a plan view of inner surface of the panel according to the present invention. Sectional views of a long side portion, a short side portion and a diagonal portion which are taken along the central of the panel are shown in FIGS. 7*a*, 7*b* and 7*c*, respectively.

Figure 7A:
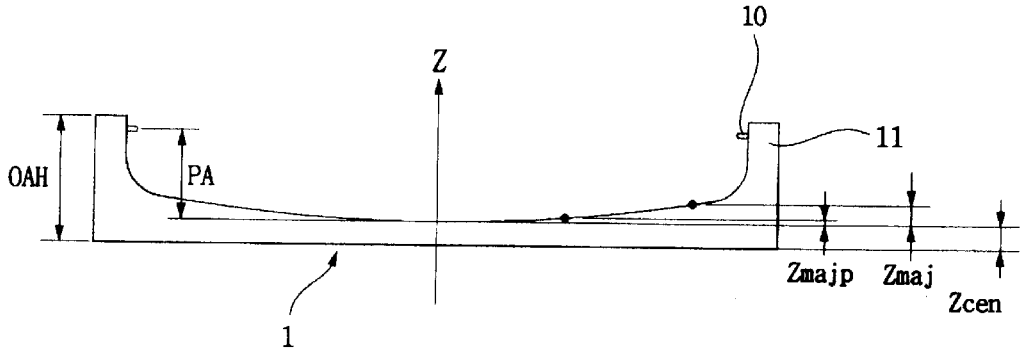
FIGS. 7*a*, 7*b* and 7*c* are sectional views taken along the long peripheral direction, the short peripheral direction and the diagonal peripheral direction with respect to FIG. 6, respectively.

FIG. 7*a* is a sectional view representing the long side portion of the panel 1. In view of the center of the inner surface of the long side portion about the short axis direction, the height difference between the thickness at the end portion of the effective area of the long side portion on which electron beams are impinged and a thickness at the center of the inner surface of the panel is defined as Zmaj, and the difference between the thickness at a half position between the end portion of the effective area of the long side portion and its center and the thickness at the center of the inner surface is defined as Zmajp.

Figure 7B:
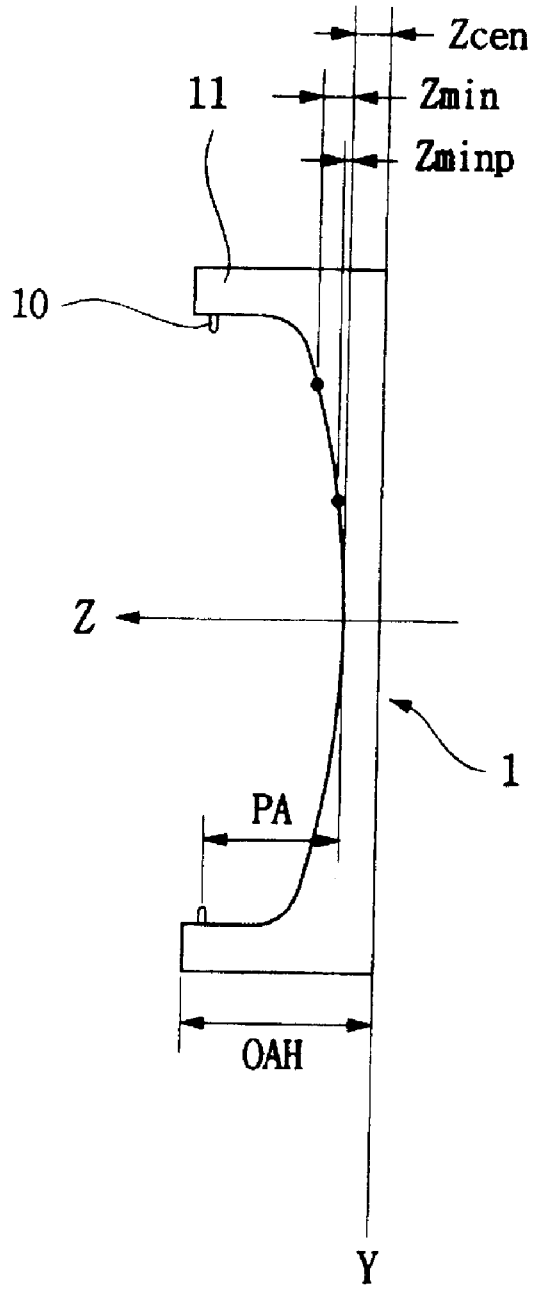

FIG. 7*b* is a sectional view representing the short side portion of the panel 1. In view of the center of the inner surface of the short side portion of the panel 1, the difference between the thickness at the end portion of the effective area of the short side portion on which electron beams are impinged and a thickness at the center of the inner surface of the panel is defined as Zmin, and the difference between the thickness at a half position between the end portion of the effective area of the short side portion and its center and the thickness at the center of the inner surface is defined as Zminp.

Figure 7C:
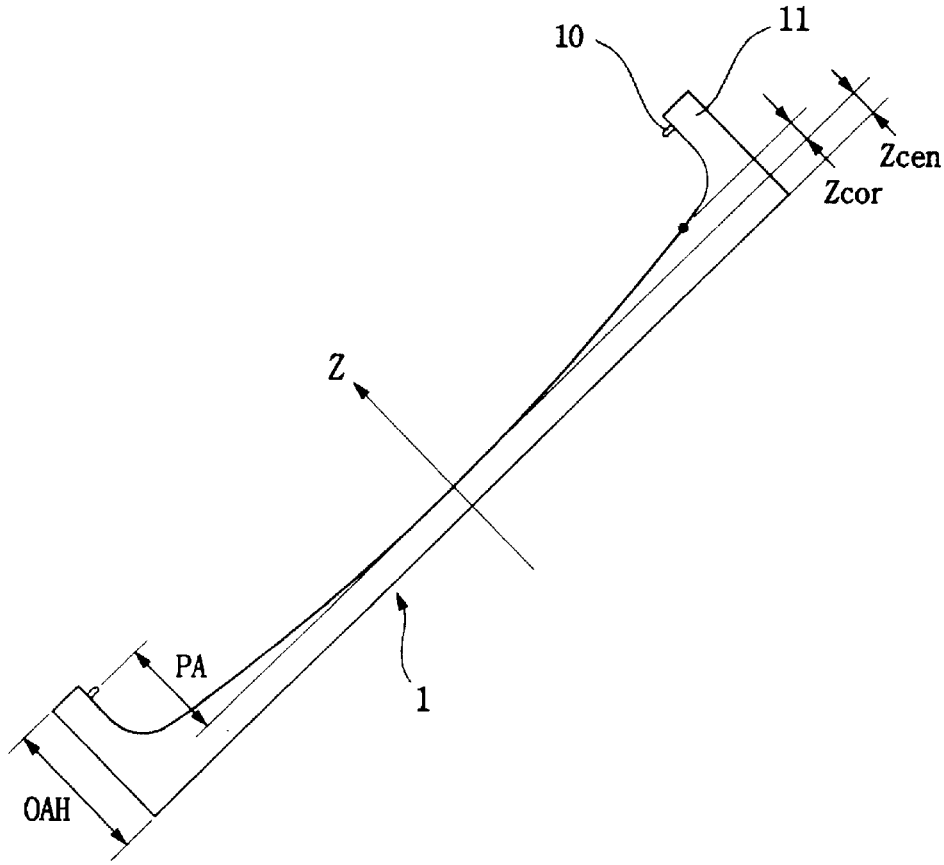

Also, FIG. 7*c* is a sectional view representing the diagonal portion of the panel 1. The difference between the thickness at the end portion of the effective area of the diagonal portion on which electron beams are impinged and a thickness at the center of the inner surface of the panel is defined as Zcor.

As an preferred embodiment of the present invention, the radius of the curvature of the inner surface of the panel for a flat-type CRT with an aspect ratio of 16:9 may have the following range when designing the panel in accordance with the above definitions.

$$0.5<(Zmaj-Zcen)/(Zcor-Zcen)<0.7, \text{ and}$$

$$0.35<(Zmin\ldots Zcen)/(Zcor\ldots Zcen)<0.45$$

Further, if ratio between the end portion of each axis of the effective area of the panel 1 and a half position of the its center is set to the range of 0.2<(Zmajp−Zcen)/(Zmaj−Zcen) <3 and 0.2<(Zminp−Zcen)/(Zmin−Zcen), the doming and howling phenomenon of the shadow mask can be prevented.

Figure 8A:
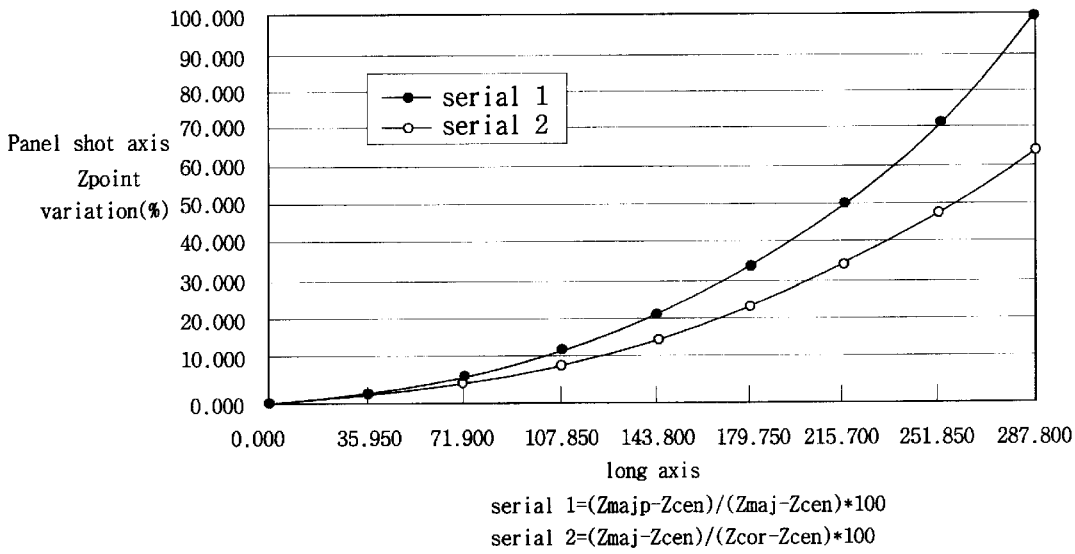
FIGS. 8*a* and 8*b* are graphs showing variations in each position the inner surface curvature of the panel according to the present invention.

FIG. 8*a* depicts the height difference in the short axis from the center of the panel to the end portion of the long axis of the effective area of the panel in the long side portion. As shown, the height difference ($Z_{point}$) from the center to the end portion of the long axis of the effective area of the panel is largely increased.

Figure 8B:
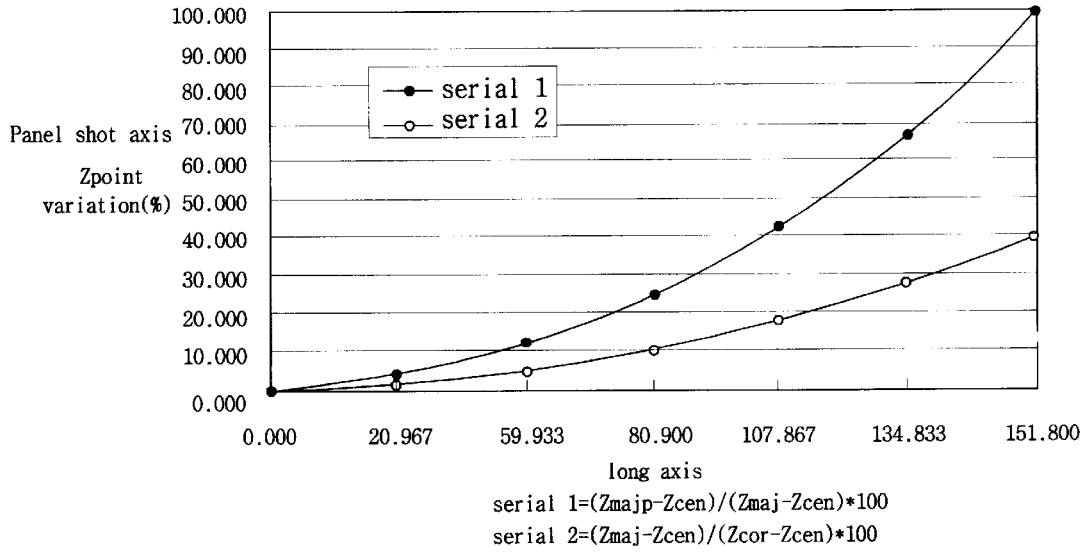

Also, such increase appears equal in the short side portion shown in FIG. 8*b*.

In graphs shown in FIGS. 8*a* and 8*b*, the serial 1 indicates the curvature formed in the case of 0.2<Zmajp−Zcen)/(Zmaj−Zcen)<0.3 and 0.2<(Zminp−Zcen)/(Zmin−Zcen) <0.3 and the serial 2 indicates the curvature formed in the case of 0.5<(Zmaj−Zcen)−(Zcor−Zcen)<0.7 and 0.35< (Zmin−Zcen)/(Zcor−Zcen)<0.45.

Accordingly, the panel 1 can be formed such that in its thickness, its outer surface is made flat and its inner surface is made thin at its center, but the thickness increases from its upper/bottom portion towards its peripheral portion, thereby providing durability against explosion and reducing a tremble of the shadow mask due to impact energy as well as the effect of the magnetic field of the earth.

On the one hand, since the height difference in the short axis direction from the outer end of the panel curved in the rear direction to the outer surface of the panel can be increased in accordance with an increase of the curvature of the panel as compared with a conventional round-type panel, the height of the skirt portion of the panel is increased as well as the distance difference PA in the short axis direction from the center (Zcen) of the inner surface of the panel to the stud pin 10 made large.

Further, an insertion space of the frame 7 which may be inserted into the inner portion of the panel is also wider, thereby increasing the height of the frame in the short axis direction.

Such height OAH of the skirt portion 11 of the panel in the short axis direction can be given by a finite element method. As the results were verified by actual measurement, the following results are given in comparison with an example of a panel structure of a conventional 28"-screen cathode ray tube.

TABLE 1

| Item | Conventional Art | The Present Invention |
|---|---|---|
| Height of the panel | 99.7 | 104.7 |
| Distance between the center of inner surface of the panel and the stud pin (PA) | 64 | 69 |

That is, as shown in FIG. 7*a*, if the shortest distance between an extended plane passing the center of the inner surface of the panel and the center of the stud pin is referred to as PA and the height of the skirt portion 11 of the panel in the short axis direction is referred to as OHA, the height of the skirt portion of the panel in the short axis direction is equivalent to 0.65<(PA)/(OAH)<0.7.

As a result, the distance between the panel and the frame is increased more than that of the conventional art, thereby improving the thermal capacity of the frame due to an increase in the volume of the frame and thus reducing the thermal expansion quantity of the frame under the same condition.

That is, a flat-type cathode ray tube according to a preferred embodiment of the present invention is constructed such that the thermal expansion coefficient of the shadow mask is formed low, the difference in the thermal expansion coefficient of the shadow mask and the frame is set to be below 0.1, the range of the curvature of the inner surface of the panel 1 is within 0.51<(Zmin−Zcen)−(Zcor−Zmaj)<0.6 and 0.51<(Zmaj−Zcen)−(Zcor−Zmin)<0.6, and the range of the height of the skirt of the panel in the short axis direction is within 0.65<(PA/OAH)<0.7.

Accordingly, when electron beams from the electron gun impinge on the shadow mask and cause a temperature increase of the shadow mask in operation of the CRT according to the present invention having such a construction as stated above, a temperature increase in the frame is relatively low due to its increased volume even though the frame has the same thermal capacity, density and weight as that of the conventional frame.

Accordingly, the results as shown in Table 2 can be obtained.

TABLE 2

| Thermal expansion quantity in each position of the panel | Example of the present invention maximum | Example of the conventional art minimum |
|---|---|---|
| Doming portion | 12 μm | 22 μm |
| End portion of the long axis | 10 μm | 17 μm |
| Corner portion | 11 μm | 16 μm |

That is, due to a low expansion quantity of the frame, the moving quantity of the shadow mask is also low and thus the doming is decreased, whereby removing the reason of deterioration of the display quality Also, because the height of the frame in the short axis direction can be increased as compared with the conventional art, a deformation in manufacturing and operating the shadow mask is prevented.

Further, due to the height increase of the frame, the inner shield plate which is installed in the rear of the frame can be sharply tapered. it causes increase of the difference of a magnetic field in the interior and exterior of the inner shield plate, thereby shielding effectively the magnetic field and preventing variation in the electron beam landing.

Also, the shadow mask can be held in a fixed position along the curvature of the inner surface of the panel by means of the rectangular frame, and the inner surface of the panel is designed within the range of 0.51<(Zmin−Zcen)−(Zcor−Zmaj)<0.6 and 0.51<(Zmaj−Zcen)−(Zcor−Zmin)<0.6, thereby improving the elastic coefficient of the panel and preventing the howling (vibration) phenomenon of the shadow mask due to a impact energy.

This can be seen from Table 3 showing the result of the experiment which was performed with comparison of the CRT having the curvature of the inner surface of the panel according to the present invention with a conventional CRT having the same size to the present invention.

TABLE 3

| | Inventive CRT | Conventional CRT |
|---|---|---|
| the number of inherent vibration | 135 Hz | 52 Hz |

That is, the present panel having its improved the number of the inherent vibration can absorb the impact energy due to an external vibration and the like and thus prevent the vibration of the shadow mask by reducing the impact energy transferred to the shadow mask.

As described in detail above, the panel having flat-designed outer surface can solve problems such as an image distortion of display screen, light reflection and the like.

Further, the inner surface of the panel is designed dividedly into the long axis direction and the short axis direction, thereby having its durability capable of satisfying the explosion characteristic. Also, the increase of the elastic power thereof prevents the howling of the shadow mask due to an impact energy, thereby reducing the landing change quantity and improving the color purity and brightness of picture.

In addition, since the height in the short axis direction in accordance with flatness of the panel is increased, the thermal capacity of the frame is increased, the doming phenomenon of the shadow mask is prevented and the magnetic field of the earth magnetism is effectively shielded. Therefore, the landing change quantity can be also reduced, and the color purity of the picture can be improved. Also, the variance rate can be lowered when manufacturing the shadow mask and operating the CRT.

What is claimed is:

1. A flat type cathode ray tube, comprising:

a panel having a phosphor screen deposited on an inner surface of the panel, wherein an outer surface of the panel is substantially planar and the inner surface has a predetermined curvature;

a funnel attached to a rear end portion of the panel;

an electron gun arranged in a neck of the funnel for emitting electron beams; and a shadow mask installed on the inner surface of the panel at a predetermined distance therefrom and having a number of apertures for passing therethrough the electron beams, wherein a range of a curvature of the inner surface of the panel is given by the following equations:

$$0.51<(Zmin-Zcen)-(Zcor-Zmaj)<0.6,$$

$$0.51<(Zmaj-Zcen)-(Zcor-Zmin)<0.6,$$

where, Zcen is a thickness at a center of the inner surface of the panel, Zmaj is a difference between the thickness at the center of the inner surface of the panel and a thickness at an end portion of the effective area of a long side portion of the panel, Zmin is a difference between the thickness at the center of the inner surface of the panel and a thickness at an end portion of an effective area of a short side portion of the panel, and Zcor is a difference between the thickness at the center of the inner surface of the panel and a thickness at the end portion of an effective area of a diagonal portion of the panel.

2. A flat type cathode ray rube, comprising:

a panel having a phosphor screen deposited on an inner surface of the panel, wherein an outer surface of the panel is substantially planar and the inner surface has a predetermined curvature;

a funnel attached to a rear end portion of the panel;

an electron gun arranged in a neck of the funnel for emitting electron beams; and a shadow mask installed on the inner surface of the panel at a predetermined distance therefrom and having a number of apertures for passing there through the electron beams, wherein a range of a curvature of the inner surface of the panel is given by the following equations:

$$0.2<(Zmajp-Zcen)/(Zmaj-Zcen)<0.3$$

$$0.2<(Zminp-Zcen)/(Zmin-Zcen)<0.3$$

where, Zmajp is a difference between a thickness at a half-way position between an end portion of an effective area of a long side portion of the panel and its center and a thickness at a center of the inner surface, Zminp is a difference between a thickness at a half-way position between end portions of an effective area of a short side portion of the panel and its center and the thickness at the center of the inner surface, Zcen is a thickness at the Center of the inner surface of the panel, Zmaj is a difference between the thickness am the center of the inner surface of the panel and a thickness at an end portion of the effective area of a long side portion of the panel, and Zmin is a difference between the thickness at the center of the inner surface of the panel and a thickness at the end portion of an effective area of the short side portion.

3. The flat type cathode ray tube according to claim 2, wherein a range of a distance of a skirt portion of the panel in a direction of the short axis is given by the following equation:

$$0.65<(PA)/(OAH)<0.7$$

where PA is the shortest distance between an extended plane passing the center of the inner surface of the panel and a center of a stud pin and OHA is a thickness of the skirt portion of the panel in the direction of the short axis.

4. A flat type cathode ray tube, comprising:

a panel having a phosphor screen deposited on an inner surface of the panel, wherein an outer surface of the panel is substantially planar and the inner surface has a predetermined curvature;

a funnel attached to a rear end portion of the panel;

an electron gun arranged in a neck of the funnel for emitting electron beams; and a shadow mask installed on the inner surface of the panel at a predetermined distance therefrom and having a number of apertures for passing therethrough the electron beams, wherein the panel has a rectangular shape having a predetermined aspect ratio, and a curvature of the inner surface of the panel is given by the following equations:

$$0.5<(Zmaj-Zcen)/(Zcor-Zcen)<0.7$$

$$0.35<(Zmin-Zcen)/(Zcor-Zcen)<0.45$$

where, Zcen is a thickness at a center of the inner surface of the panel. Zmaj is a difference between the thickness at the center of the inner surface of the panel and a thickness at an end portion of the effective area of a long side portion of the panel, Zmin is a difference between a thickness at the center of the inner surface of the panel and a thickness at an end portion of an effective area of a short side portion of the panel, and Zcor is a difference between the thickness at the center of the inner surface of the panel and a thickness at an end portion of an effective area of a diagonal portion of the panel.

5. The flat type cathode ray tube of claim 4, wherein the aspect ratio of the panel is 16:9.

6. An improved panel for a flat type cathode ray rube, the panel having a phosphor screen deposited on an inner surface of the panel, wherein an outer surface of the panel is substantially planar and the inner surface has a predetermined curvature, the improvement comprising:

a range of a curvature of the inner surface of the panel is given by the following equations:

$$0.51<(Zmin-Zcen)-(Zcor-Zmaj)<0.6,$$

$$0.51<(Zmaj-Zcen)-(Zcor-Zmin)<0.6.$$

where, Zcen is a thickness at a center of the inner surface of the panel, Zmaj is a difference between the thickness at the center of the inner surface of the panel and a thickness at an end portion of the effective area of a long side portion of the panel, Zmin is a difference between the thickness at the center of the inner surface of the panel and a thickness at an end portion of an effective area of a short side portion of the panel, and Zcor is a difference between the thickness at the center of the inner surface of the panel and a thickness at the end portion of an effective area of a diagonal portion of the panel.

7. An improved panel for a flat type cathode ray tube, the panel having a phosphor screen deposited on an inner surface of the panel, wherein an outer surface of the panel is substantially planar and the inner surface has a predetermined curvature, the improvement comprising:

a range of a curvature of the inner surface of the panel is given by the following equations:

$$0.2<(Zmajp-Zcen)/(Zmaj-Zcen)<0.3$$

$$0.2<(Zminp-Zcen)/(Zmin-Zcen)<0.3$$

where, Zmajp is a difference between a thickness at a half-way position between an end portion of an effective area of a long side portion of the panel and its center and a thickness at a center of the inner surface, Zminp is a difference between a thickness at a half-way position between end portions of an effective area of a short side portion of the panel and its center and the thickness at the center of the inner surface, Zcen is a thickness at the center of the inner surface of the panel, Zmaj is a difference between the thickness at the center of the inner surface of the panel and a thickness at an end portion of the effective area of a long side portion of the panel, and Zmin is a difference between the thickness at the center of the inner surface of the panel and a thickness at the end portion of the effective area of the short side portion.

8. The panel according to claim 7, wherein a range of a distance of a skirt portion of the panel in a direction of the short axis is given by the following equation:

$$0.65<(PA)/(OAH)<0.7$$

where PA is the shortest distance between an extended plane passing the center of the inner surface of the panel and a center of a stud pin and OHA is a thickness of the skirt portion of the panel in the direction of the short axis.

9. An improved panel for a flat type cathode ray rube, the panel having a phosphor screen deposited on an inner surface of the panel, wherein an outer surface of the panel is substantially planar and the inner surface has a predetermined curvature, the improvement comprising:

the panel has a rectangular shape having a predetermined aspect ratio, and a curvature of the inner surface of the panel is given by the following equations:

$$0.5<(Zmaj-Zcen)/(Zcor-Zcen)<0.7$$

$$0.35<(Zmin-Zcen)/(Zcor-Zcen)<0.45$$

where, Zcen is a thickness at a center of the inner surface of the panel, Zmaj is a difference between the thickness at the center of the inner surface of the panel and a thickness at an end portion of the effective area of a long side portion of the panel, Zmin is a difference between a thickness at the center of the inner surface of the panel and a thickness at an end portion of an effective area of a short side portion of the panel, and Zcor is a difference between the thickness at the center of the inner surface of the panel and a thickness at an end portion of an effective area of a diagonal portion of the panel.

10. The improved panel of claim 9, wherein the aspect ratio of the panel is 16:9.

* * * * *